US008303054B2

(12) United States Patent
Mattle

(10) Patent No.: US 8,303,054 B2
(45) Date of Patent: Nov. 6, 2012

(54) DRIVE FOR A MOVABLE FURNITURE ELEMENT

(75) Inventor: Klaus Mattle, Koblach (AT)

(73) Assignee: Julius Blum GmbH, Hoechst (AT)

( * ) Notice: Subject to any disclaimer, the term of this patent is extended or adjusted under 35 U.S.C. 154(b) by 469 days.

(21) Appl. No.: 12/606,428

(22) Filed: Oct. 27, 2009

(65) Prior Publication Data

US 2010/0043595 A1 Feb. 25, 2010

Related U.S. Application Data

(63) Continuation of application No. PCT/AT2008/000152, filed on Apr. 25, 2008.

(30) Foreign Application Priority Data

May 7, 2007 (AT) ..... A 695/2007

(51) Int. Cl.
*A47B 95/02* (2006.01)

(52) U.S. Cl. ..... 312/319.5; 312/325; 318/663

(58) Field of Classification Search .... 312/319.5–319.7, 312/327–328, 325, 319.8, 138.1, 139; 49/339–341, 49/345; 310/183; 318/663
See application file for complete search history.

(56) References Cited

U.S. PATENT DOCUMENTS

| | | | | |
|---|---|---|---|---|
| 2,912,237 | A * | 11/1959 | Snyder | 49/199 |
| 5,663,619 | A * | 9/1997 | Andersson | 318/400.37 |
| 6,002,217 | A * | 12/1999 | Stevens et al. | 318/9 |
| 6,283,535 | B1 * | 9/2001 | Yuge | 296/146.8 |
| 6,898,900 | B2 * | 5/2005 | Haag et al. | 49/342 |
| 7,448,703 | B2 * | 11/2008 | Kung | 312/327 |
| 7,478,891 | B2 * | 1/2009 | Hollenstein | 312/319.2 |
| 7,500,287 | B2 * | 3/2009 | Brustle | 16/286 |
| 7,573,215 | B2 * | 8/2009 | Hillen | 318/280 |
| 8,011,741 | B2 * | 9/2011 | Mattle | 312/319.5 |
| 8,029,078 | B2 * | 10/2011 | Gasser | 312/319.5 |
| 8,066,341 | B2 | 11/2011 | Brüstle | |
| 2004/0016180 | A1 * | 1/2004 | Hellinga et al. | 49/345 |
| 2004/0100169 | A1 * | 5/2004 | Huber et al. | 312/319.5 |
| 2007/0180654 | A1 | 8/2007 | Gasser | |

FOREIGN PATENT DOCUMENTS

| | | |
|---|---|---|
| DE | 20 2007 006 884 | 8/2007 |
| DE | 20 2006 006 190 | 10/2007 |
| WO | 2004/100718 | 11/2004 |
| WO | 2006/017864 | 2/2006 |
| WO | 2006/099645 | 9/2006 |
| WO | 2007/009133 | 1/2007 |
| WO | 2007/009135 | 1/2007 |
| WO | 2007/098515 | 9/2007 |

OTHER PUBLICATIONS

International Search Report issued Aug. 21, 2008 in International (PCT) Application No. PTC/AT2008/000152.

Austrian Search Report issued Jan. 22, 2008 in Austrian Application No. A 695/2007.

* cited by examiner

*Primary Examiner* — Hanh V Tran

(74) *Attorney, Agent, or Firm* — Wenderoth, Lind & Ponack, L.L.P.

(57) ABSTRACT

A drive for a movable furniture element has an actuating element for moving the furniture element and a motor for driving the actuating element. The actuating element and the furniture element may at times be moved independently of one another, and a position measurement system is provided for determining both the position of the actuating element and the position of the furniture element.

16 Claims, 5 Drawing Sheets

DRIVE FOR A MOVABLE FURNITURE ELEMENT

This application is a Continuation of International Application No. PCT/AT2008/000152, filed Apr. 25, 2008.

BACKGROUND OF THE INVENTION

The present invention concerns a drive for a movable furniture part, comprising an adjusting member for moving the furniture part and a motor for driving the adjusting member, wherein the adjusting member and the furniture part are at times movable independently of each other.

Drives of the general kind set forth are already known, in which the position or movement parameters derived therefrom of the adjusting member or the movable furniture part can be determined by way of a position measuring device.

For example WO 2006/017864 A1 on pages 5 through 6 (fourth variant of the invention described in WO 2006/017864 A1) describes a drive for a movable furniture part comprising a position measuring device by which the position of the adjusting member (ejection lever) can be determined. In addition, the above-indicated specification on page 7 thereof describes the possibility of coupling the position measuring device to the furniture part itself, instead of to the adjusting member. In the embodiment shown in FIGS. 18 and 20, that is effected either by way of a spring-loaded thrust member or by way of an entrainment member which can be coupled to the movable furniture part over a certain distance.

The state of the art suffers from the problem that it is not possible to detect the position or movement parameters derived therefrom selectively or simultaneously both for the furniture part and also for the adjusting member. More specifically, the position and movement cannot be detected independently of whether the adjusting member is or is not just in contact with the furniture part.

The object of the invention is to overcome that problem, and is attained by a drive having the features described below.

There can be various reasons why the adjusting member and the furniture part are at times movable independently of each other. For example, the adjusting member, for moving the furniture part, can loosely contact the furniture part. That situation arises when the adjusting member is in the form of an ejection lever or thrust member. More specifically, the ejection lever or thrust member bears against the furniture part only over its pivotal or extension travel.

It can, however, also be the case that the adjusting member in itself is fixedly connected to the furniture part but a coupling is arranged in the drive train between the motor which drives the adjusting member and the furniture part, wherein the drive train can be disengaged by the coupling. It may be desirable, for example, if the movable furniture part is movable manually by a user without—in that case—the user being impeded by the motor. That is advantageous if the motor is defective or the user for example wants a higher speed than that of the furniture part when driven by the motor.

It can, however, also be the case that the coupling is in the form of an overload coupling to avoid damage to or destruction of the adjusting member or the motor. Without such an overload coupling, the adjusting member, when the movable furniture part is loaded with excessive forces, can transmit those forces to the motor or a transmission.

In regard to all those possible options, it is possible with a drive according to the invention to determine the position or movement parameters derived therefrom (such as speed or acceleration) of the adjusting member and/or the furniture part, even if the adjusting member and the furniture part are just moving independently of each other.

The fact that the position or movement parameters derived therefrom of the furniture part can be continuously determined means that it is, for example, possible to constantly maintain a touch-latch functionality with respect to the drive. This means that a user can cause activation of the motor by the application of a force to the furniture part and the change in position or speed of the furniture part, that is caused thereby. That is desirable, in particular, when the motor is active only over a part of the total travel of the furniture part in order to again trigger the motor.

The effect of determining the position or derived movement parameters of the adjusting member can also be used on the one hand to implement a touch-latch functionality. In this case, for example, the motor is activated upon a change in the position or speed of the adjusting member.

On the other hand, the motor can also be intended by way of the adjusting member to implement a predetermined travel, speed, or acceleration profile for the furniture part. To permit the dependency on the position or speed or acceleration in regulated relationship, it will be appreciated that there must be a suitable position measuring device and possibly a clock and a computing unit.

It is also possible to provide for collision monitoring by using the position measuring device. The position (location or travel) of the movable furniture part is measured in that case and monitored by a control or regulating device for a change in speed or acceleration. The operation of ascertaining the speed or acceleration of the movable furniture part can be effected, for example, by forming the first or second derivative of the position in dependence on time. If the change in speed or acceleration differs from a reference value which was established earlier, then the motor can be switched off. Examples of collisions include a user who is standing under a movable item of furniture in the form of a flap and who blocks the closing movement of the flap, or an article projecting from a body or carcass of an item of furniture and which prevents a drawer or flap from closing.

In a particularly preferred embodiment of the invention, the position measuring device can have at least one potentiometer. Particularly preferably, however, there are two potentiometers, in which case a respective potentiometer is associated with the adjusting member and the furniture part, respectively. Absolute position determination can be effected by potentiometers. However, purely incremental position determination may also be adequate for the invention.

It is particularly preferably provided that the motor is in the form of an electric motor.

If control or regulation of the drive is desired, it will be appreciated that a control or regulating device must be provided, to which the signals of the position measuring device can be passed.

It will be self-evident that the position measuring device can physically also be in the form of two components which are spatially separate from each other. Alternatively, it is possible to provide a single component with which there are associated two measuring sensors (for the adjusting member and the furniture part) which operate separately from each other.

BRIEF DESCRIPTION OF THE DRAWINGS

Further advantages and details of the invention will be apparent from the Figures and the related specific description. In the drawings.

DETAILED DESCRIPTION OF THE INVENTION

FIGS. 1 through 4 show an embodiment of the invention incorporated into a flap drive system 1.

Figure 1:
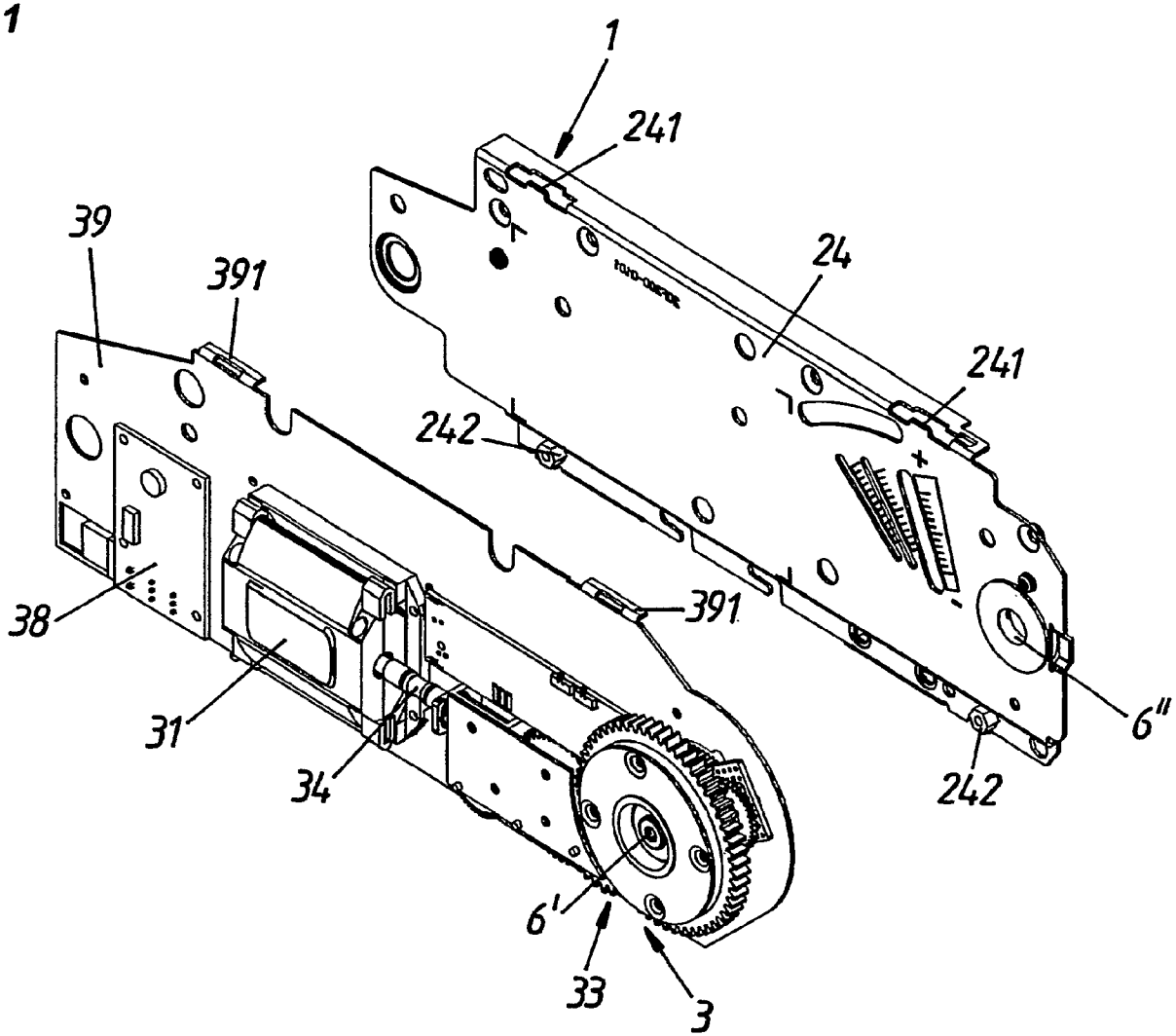
FIGS. 1 through 4 show various views of an embodiment of the invention in a flap drive system.
Figure 2:
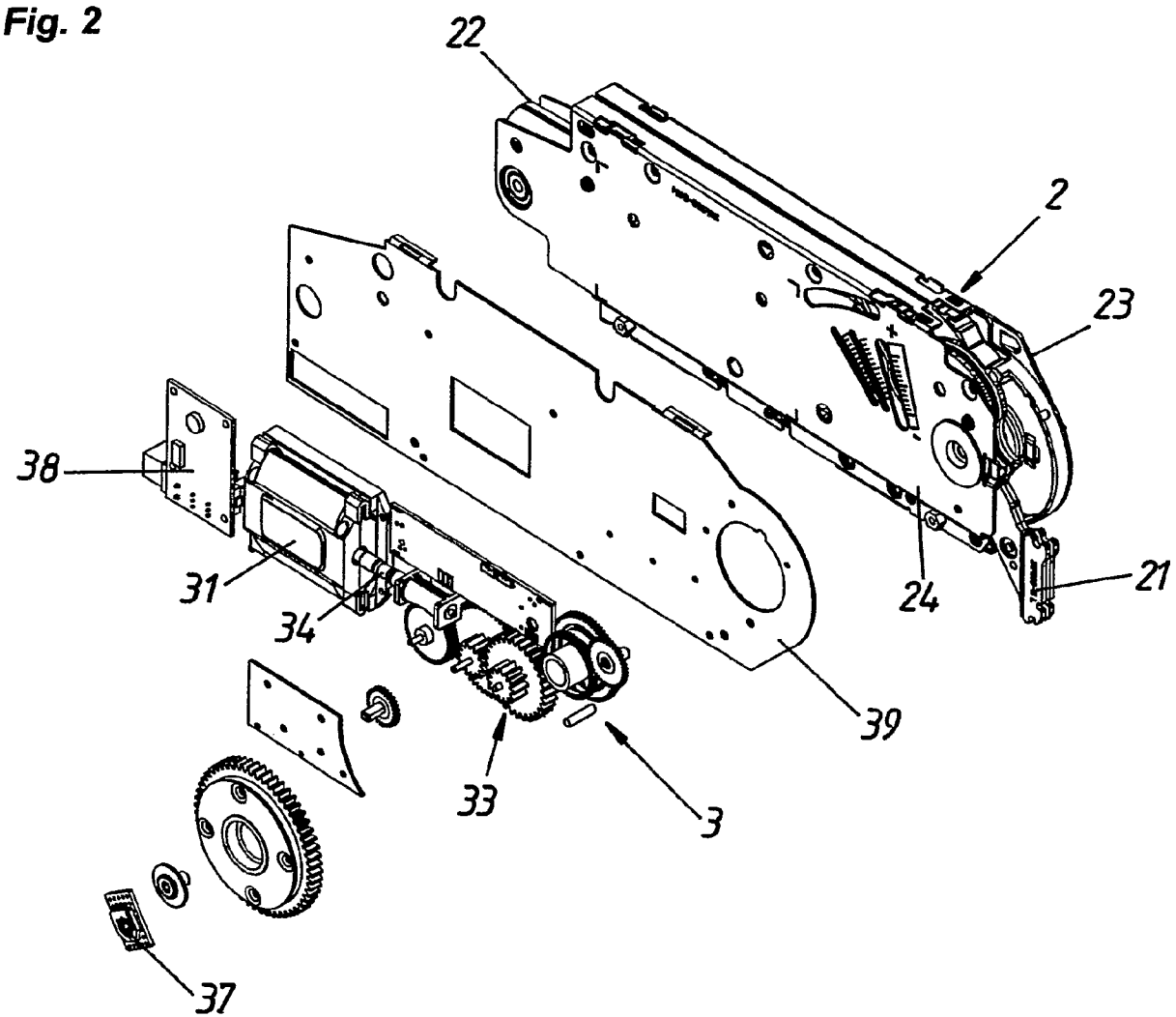

In this case, FIG. 1 shows a cover surface 24 of a mechanical adjusting unit (adjusting member) 2 which is not shown in greater detail in FIG. 2. The cover surface 24 has two projections 241 which serve to suspend (support) the base plate 39 of an electric drive 3. In that case, it is suspended by lugs 391. After it has been suspended in place, the electric drive 3 and the mechanical adjusting unit (adjusting member) 2 can be screwed together by screws, in which case (in this embodiment) the cover surface 24 has suitable receiving means 242 for the screws. It is further possible to see in FIG. 2 the transmission 33, the electric motor 31, and a coupling 34 connecting those two components together (in this embodiment, it is of a mechanically flexible nature). In addition, fixed on the base plate 39 is a circuit board 38 having the circuits of a control or regulating unit.

The interface 6 is here in the form of the central spindle 6' of the electric drive 3 and a receiving means (not shown) for the spindle 6', which is arranged behind a receiving opening 6" on the adjusting member 2.

FIG. 2 shows the mechanical adjusting unit (adjusting member) 2 as an overall unit, as can already be fixed in a body or carcass of an item of furniture (not shown in FIG. 2). In this case, the mechanical adjusting unit 2 has an adjusting arm 21 which is subjected to the action of a spring storage device 22 (here: a spring pack) which is not shown in detail in FIG. 2 but which corresponds to the state of the art device.

The housing of the adjusting member 2 has a base surface 23 with which the adjusting member 2 can be fixed to a carcass or body of an item of furniture. Arranged at a spacing (spaced apart) therefrom and substantially parallel thereto is the cover surface 24 which serves for fixing the electric drive 3 to the adjusting unit 2.

Figure 3A:
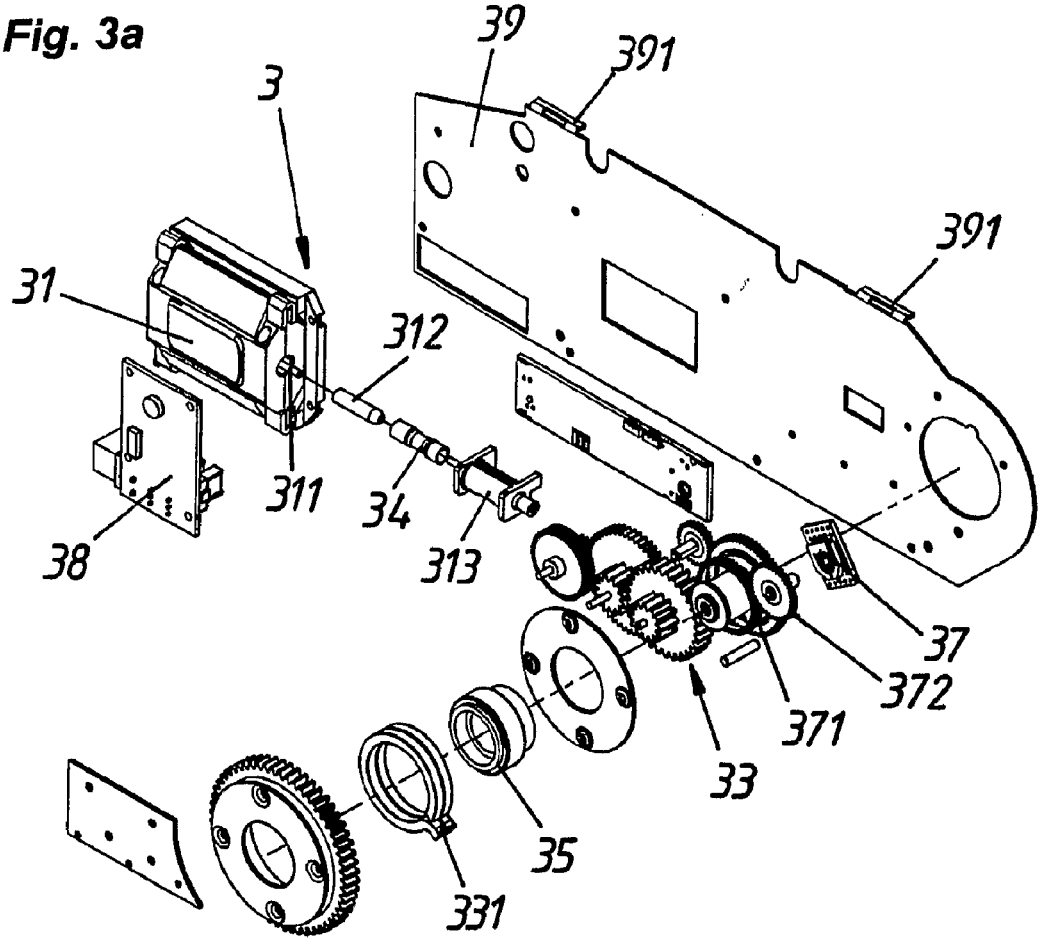
Figure 3B:
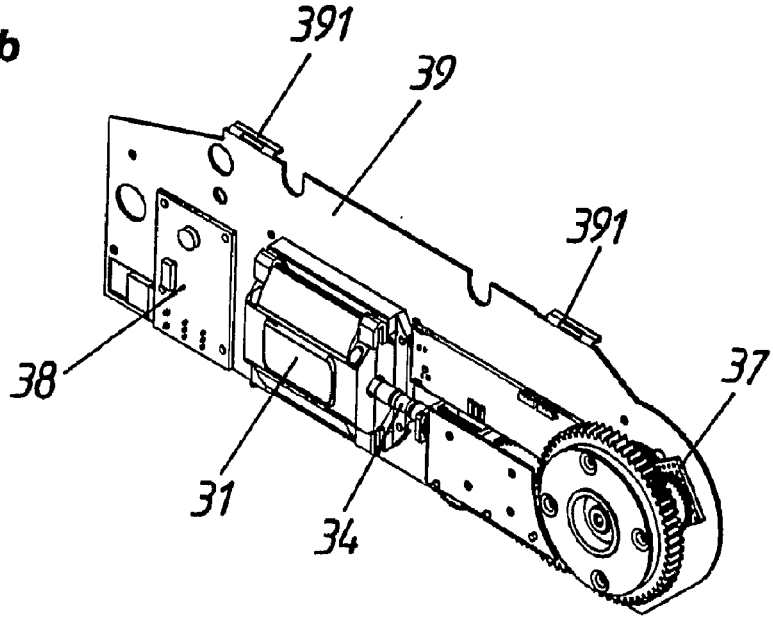

In relation to the electric drive 3, FIG. 2 in comparison with FIG. 1 shows a potentiometer 37 co-operating with the end stage of the transmission 33 (see, in that respect, the exploded view in FIG. 3). The position of the adjusting arm 21 and thus the position of the flap 4 (not shown in FIG. 2) can be determined by the potentiometer 37 as the end stage of the transmission 33 co-operates with the adjusting arm 21 without slippage via the interface 6 (not shown in FIG. 2), even if the adjusting member (and motor) operate independently of the adjusting arm 21 and furniture part 4.

A second potentiometer is not separately shown in the Figures, that second potentiometer being mounted directly on the circuit board 38 by suitable circuits. By way of the second potentiometer, it is possible to determine the position of the adjusting member 2, via the drive output of the electric motor 31.

FIG. 3 shows the actual arrangement of the potentiometer 37 relative to the transmission 33. In this case, a toothed ring 371 is non-rotatably connected to the end stage of the transmission 33 and co-operates with a gear 372 in such a way that there is a 2:1 transmission ratio with respect to the movement of the end stage of the transmission 33 to the gear 372. That means that the measuring range of the potentiometer 37 with which the gear 372 co-operates can be better utilized.

It can further be seen from FIG. 3 that a pin 312 is fitted in place at the drive output 311 of the electric motor 31, and the pin 312 is fitted into the coupling 34 (here: a mechanically flexible tube coupling). Arranged on the other side of the coupling 34 in a housing 313 is a worm gear co-operating with the first stage of the transmission 33.

The electric drive 3 further has an overload coupling 331 and a freewheel coupling 35 within the drive train between the motor 31 and the adjusting arm 21 of the adjusting member 2 which is fixed to the flap 4. In that case, the overload coupling 331 can disconnect the transmission 33 from the adjusting member 2 to prevent unwanted destruction of the gears of the transmission 33 caused by an excessive loading acting on the adjusting arm 21. The freewheel coupling 35 permits intervention on the part of a user when the flap 4 is being driven without being impeded in that respect by the motor 31. In other words, as with the overload coupling 331, the freewheel coupling 35 allows the flap 4 to be disengaged (disconnected) from the motor 31, if necessary.

FIG. 4 again shows a perspective view of the flap drive system 1 as shown in previous FIGS. 1 through 3, wherein the electric drive 3 is fixed in the form of a self-contained component to the mechanical adjusting member 2.

Figure 4:
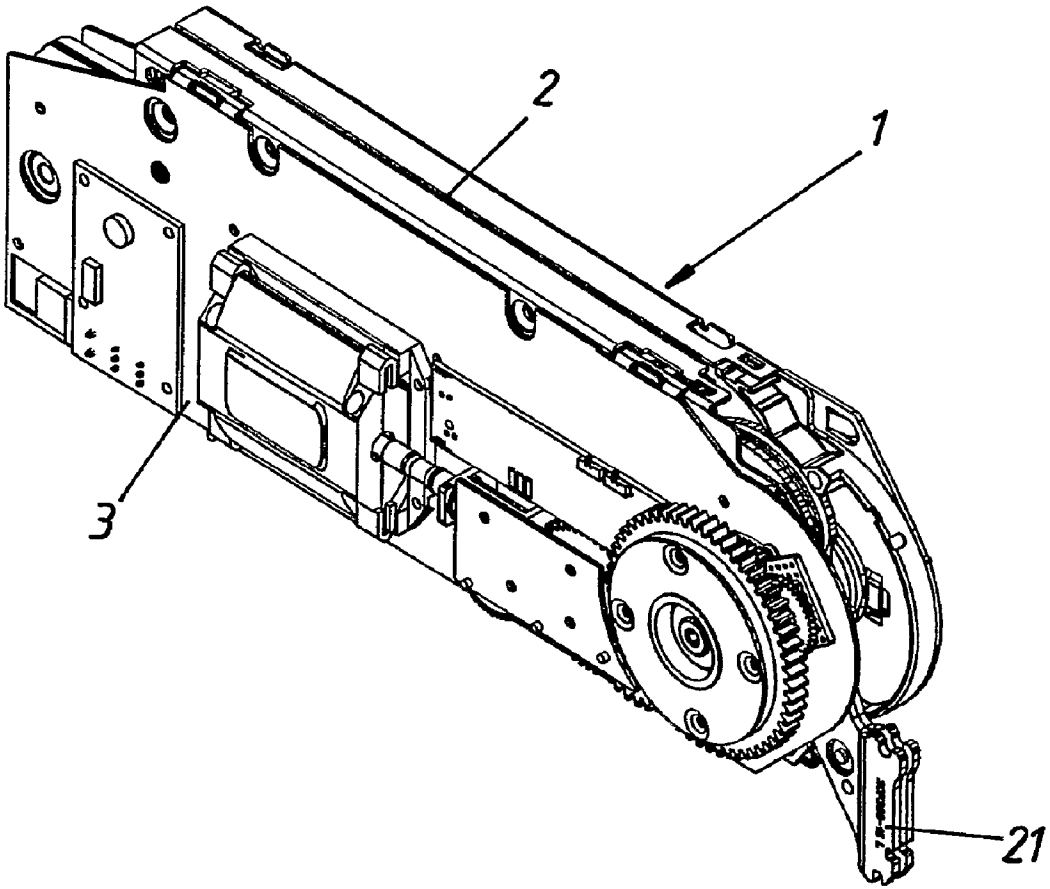

Although it is advantageous for the electric drive 3 to be fixed to an adjusting unit 2 even when the adjusting unit 2 is already mounted to a body or carcass 5 of an item of furniture (See FIG. 5), it will be appreciated that pre-fabrication of the flap drive 1 can also be effected in the form shown in FIG. 4.

Figure 5:
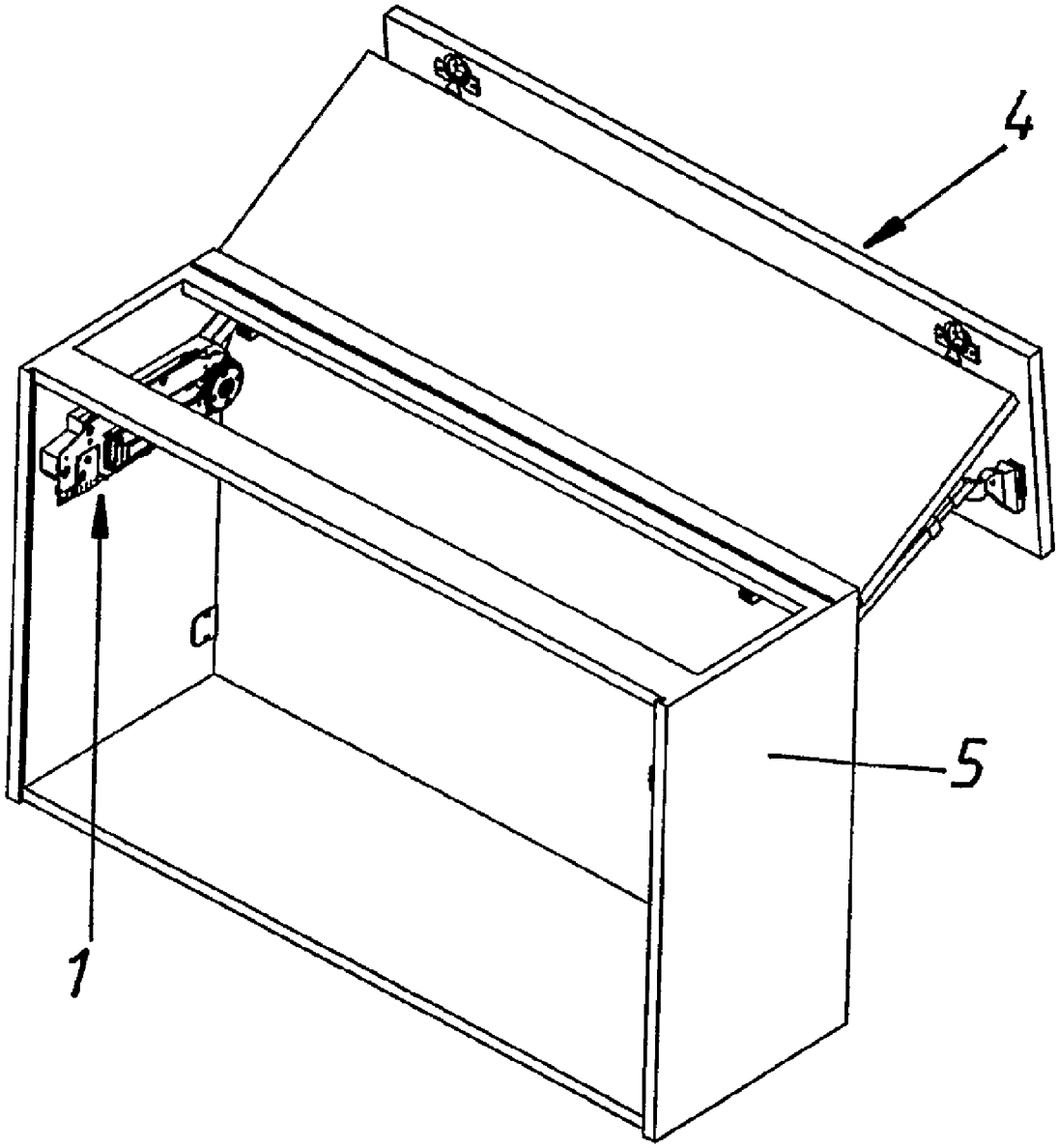
FIG. 5 shows a perspective view of a body or carcass of an item of furniture with a fitted flap drive system as shown in FIGS. 1 through 4.

FIG. 5 shows a body or carcass 5 of an item of furniture with a flap 4 mounted movably thereto and a flap drive system 1 as shown in FIGS. 1 through 4.

The invention claimed is:

1. A drive system for moving a movable furniture part, comprising:

an adjusting member including an adjusting arm configured to be fixed to the furniture part so as to move the furniture part;

a motor for driving said adjusting member;

a drive train between said motor and said adjusting arm, said drive train including a coupling comprising at least one of a freewheel coupling and an overload coupling configured to allow said motor to be disconnected from said adjusting arm so that said motor will operate independently of said adjusting arm; and a position measuring device configured to detect a position of said adjusting member and a position of the furniture part.

2. The drive system of claim 1, wherein said position measuring device comprises a potentiometer.

3. The drive system of claim 1, wherein said motor comprises an electric motor.

4. The drive system of claim 1, further comprising a control unit for receiving position signals from said position measuring device.

5. The drive system of claim 4, wherein said control unit is configured to control said motor depending on the position signals received from said position measuring device.

6. The drive system of claim 1, wherein said drive train further comprises a transmission, said position measuring device being located at an end of said transmission cooperating with said adjusting arm of said adjusting member.

7. The drive system of claim 6, wherein said position measuring device is configured to measure a position of said adjusting arm even if said adjusting arm is disconnected from said motor via said coupling.

8. The drive system of claim 1, wherein said drive train further comprises a transmission, said coupling further comprising a mechanically flexible coupling located between said motor and said transmission.

9. An article of furniture comprising:

a furniture body;

a movable furniture part movably mounted to said furniture body; and a drive system for moving said movable furniture part relative to said furniture body, said drive system including:

an adjusting member including an adjusting arm fixed to said furniture part so as to move said furniture part;

a motor for driving said adjusting member;

a drive train between said motor and said adjusting arm, said drive train including a coupling comprising at least one of a freewheel coupling and an overload coupling configured to allow said motor to be disconnected from said adjusting arm so that said motor will operate independently of said adjusting arm; and a position measuring device configured to detect a position of said adjusting member and a position of said furniture part.

10. The article of furniture of claim 9, wherein said position measuring device comprises a potentiometer.

11. The article of furniture of claim 9, wherein said motor comprises an electric motor.

12. The article of furniture of claim 9, further comprising a control unit for receiving position signals from said position measuring device.

13. The article of furniture of claim 12, wherein said control unit is configured to control said motor depending on the position signals received from said position measuring device.

14. The article of furniture of claim 9, wherein said drive train further comprises a transmission, said position measuring device being located at an end of said transmission cooperating with said adjusting arm of said adjusting member.

15. The article of furniture of claim 14, wherein said position measuring device is configured to measure a position of said adjusting arm even if said adjusting arm is disconnected from said motor via said coupling.

16. The article of furniture of claim 9, wherein said drive train further comprises a transmission, said coupling further comprising a mechanically flexible coupling located between said motor and said transmission.

* * * * *